US006412386B1

(12) United States Patent
Tseng

(10) Patent No.: US 6,412,386 B1
(45) Date of Patent: Jul. 2, 2002

(54) BRAIDED RIBBON AND ITS FABRICATION METHOD

(76) Inventor: Tony Tseng, No. 575, Ho Kang Rd., Ho Mei Town, Chang Hua Hsien (TW)

( * ) Notice: Subject to any disclaimer, the term of this patent is extended or adjusted under 35 U.S.C. 154(b) by 0 days.

(21) Appl. No.: 09/814,479

(22) Filed: Mar. 14, 2001

(51) Int. Cl.[7] ..... D04C 1/00

(52) U.S. Cl. ..... 87/9

(58) Field of Search ..... 87/9; 139/22

(56) References Cited

U.S. PATENT DOCUMENTS 4,252,871 A * 2/1981 Sundberg ..... 429/140
4,348,805 A * 9/1982 Gibbons ..... 29/857
4,835,990 A * 6/1989 Zorini ..... 66/209

FOREIGN PATENT DOCUMENTS

WO WO93/20563 * 10/1993

* cited by examiner

*Primary Examiner*—Andrew Falik
(74) *Attorney, Agent, or Firm*—Pro-Techtor International Services

(57) ABSTRACT

A braided ribbon fabrication method including the steps of (1) installing a disk-like thread guide in a ribbon braiding machine, the disk-like thread guide having a center through hole and a plurality of thread holes equiangularly spaced around the center through hole, (2) inserting a cord member through the center through hole of the disk-like thread guide and alternatively inserting different thickness of threads through the thread holes of the disk-like thread guide, (3) braiding the cord member and the threads into a braided ribbon, enabling the braided ribbon to be extended out of an output barrel, and (4) applying a rotary external force to the braided ribbon that extends out of the output barrel during braiding, so as to produce a pattern of a braided stripe in the finished braided ribbon.

9 Claims, 4 Drawing Sheets

BRAIDED RIBBON AND ITS FABRICATION METHOD

BACKGROUND OF THE INVENTION

The present invention relates to a braided ribbon and its fabrication method and, more particularly, to the method of fabricating a braided ribbon having a spiral pattern of stripe and a wave-like pattern of stripe.

Regular braided ribbons commonly have only one particular color. A single color braided ribbon is less attractive. Recently compound color braided ribbons have been created. These compound color braided ribbons are braided from different colors of threads. However, the pattern of the braided stripe of these compound color braided ribbons is monotonous.

SUMMARY OF THE INVENTION

The present invention has been accomplished under the circumstances in view. It is the main object of the present invention to provide a braided ribbon fabrication method, which is practical to fabricate braided ribbons having attractive patterns of braided stripe. It is another object of the present invention to provide braided ribbons, which have attractive patterns of braided stripe. According to the present invention, the braided ribbon fabrication method comprises the steps of (1) installing a disk-like thread guide in a braided ribbon braiding machine, the disk-like thread guide having a center through hole and a plurality of thread holes equiangularly spaced around the center through hole, (2) inserting a cord member through the center through hole of the disk-like thread guide and alternatively inserting different thickness of threads through the thread holes of the disk-like thread guide, (3) braiding the cord member and the threads into a braided ribbon, enabling the braided ribbon to be extended out of an output barrel, and (4) applying a rotary external force to the braided ribbon that extends out of the output barrel during braiding, so as to produce a pattern of braided stripe in the finished braided ribbon. In one example of the present invention, the application of the rotary external force is to twist the braided ribbon that extends out of the output barrel, so as to produce a wave-like pattern of braided stripe in the finished braided ribbon. In another example of the present invention, the application of the rotary external force is to apply a 360° rotary force to the braided ribbon that extends out of the output barrel alternatively clockwise and counter-clockwise during braiding, so as to produce a spiral pattern of braided stripe in the finished braided ribbon. In still another example of the present invention, the application of the rotary external force is to twist the braided ribbon that extends out of the output barrel and then to apply a 360° rotary force to the braided ribbon that extends out of the output barrel during braiding alternatively clockwise and counter-clockwise, so as to produce a wave-like pattern of braided stripe and a spiral pattern of braided stripe in the finished braided ribbon.

DETAILED DESCRIPTION OF THE PREFERRED EMBODIMENT

Figure 1:
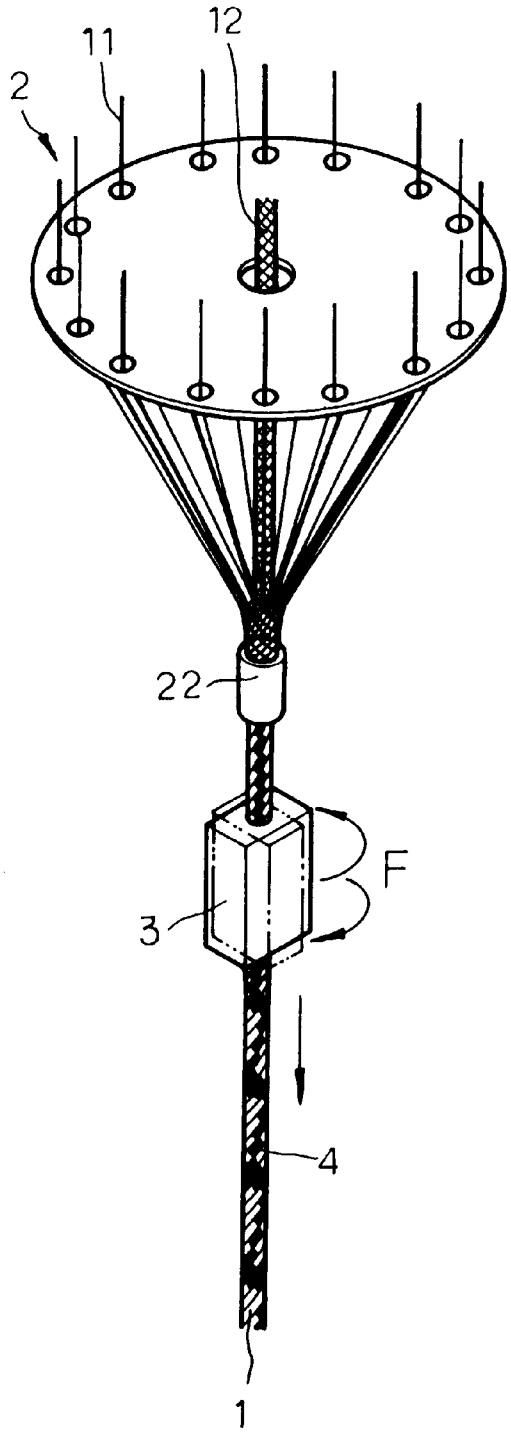
FIG. 1 is a schematic drawing showing the fabrication of a braided ribbon according to the present invention.
Figure 2:
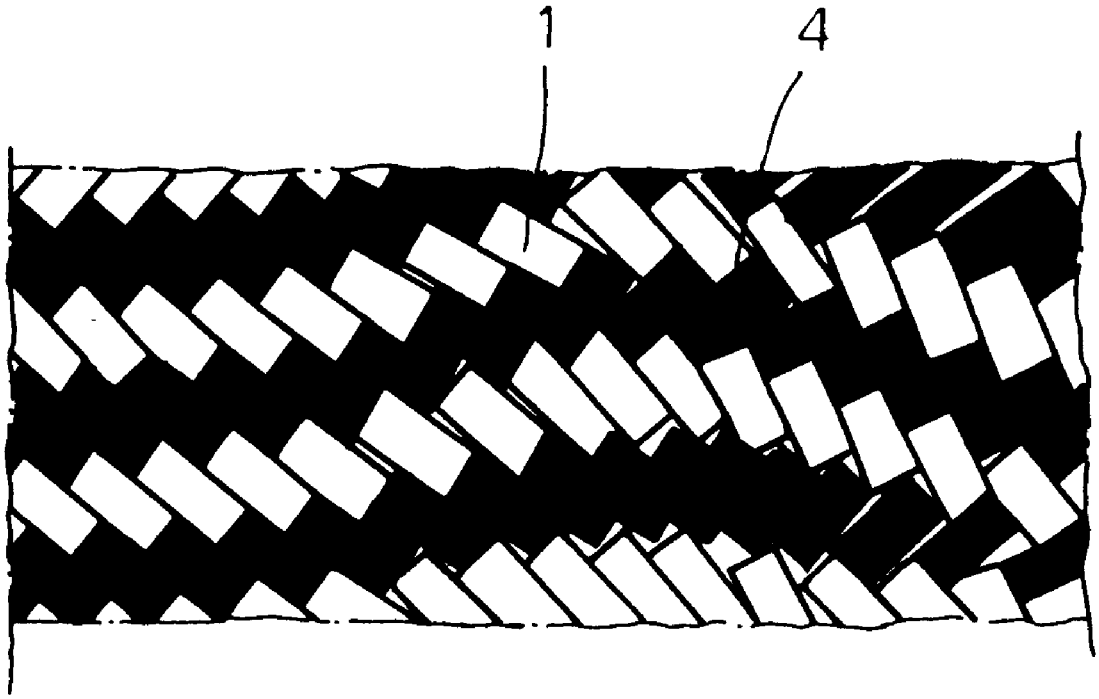
FIG. 2 is a plain view of a braided ribbon with a spiral pattern of braided stripe according to the present invention.
Figure 3:
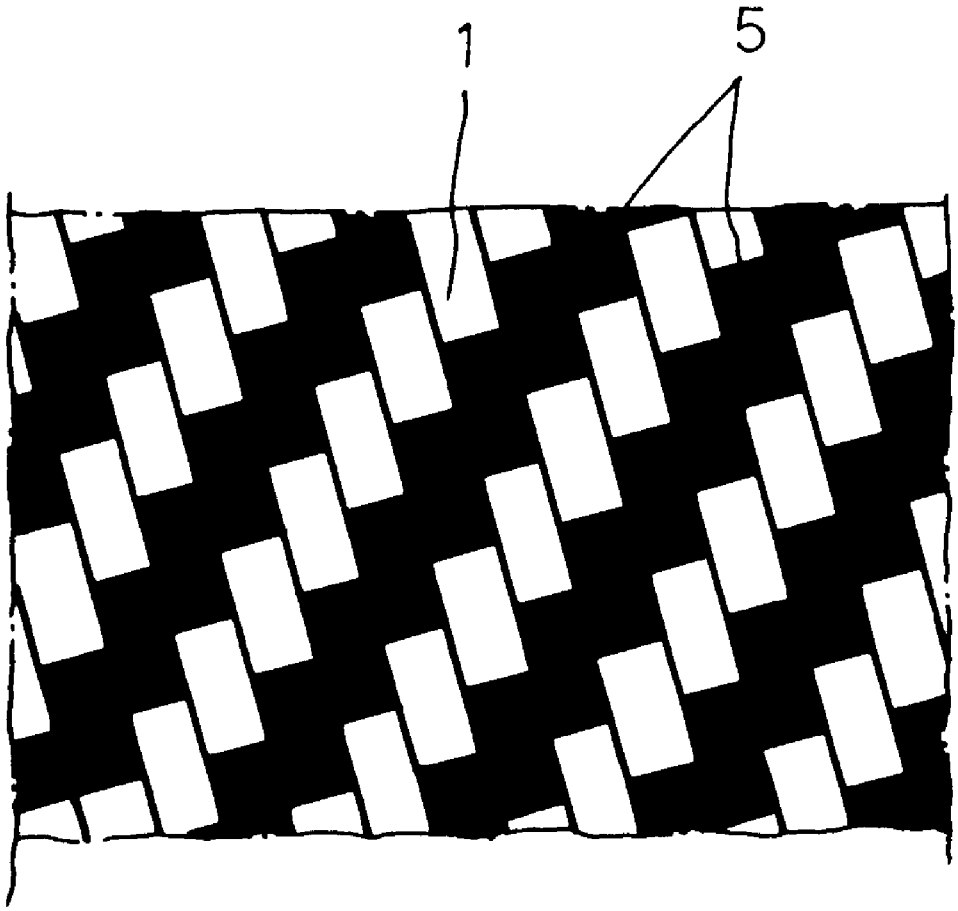
FIG. 3 is a plain view of a braided ribbon with a wave-like pattern of braided stripe according to the present invention.
Figure 4:
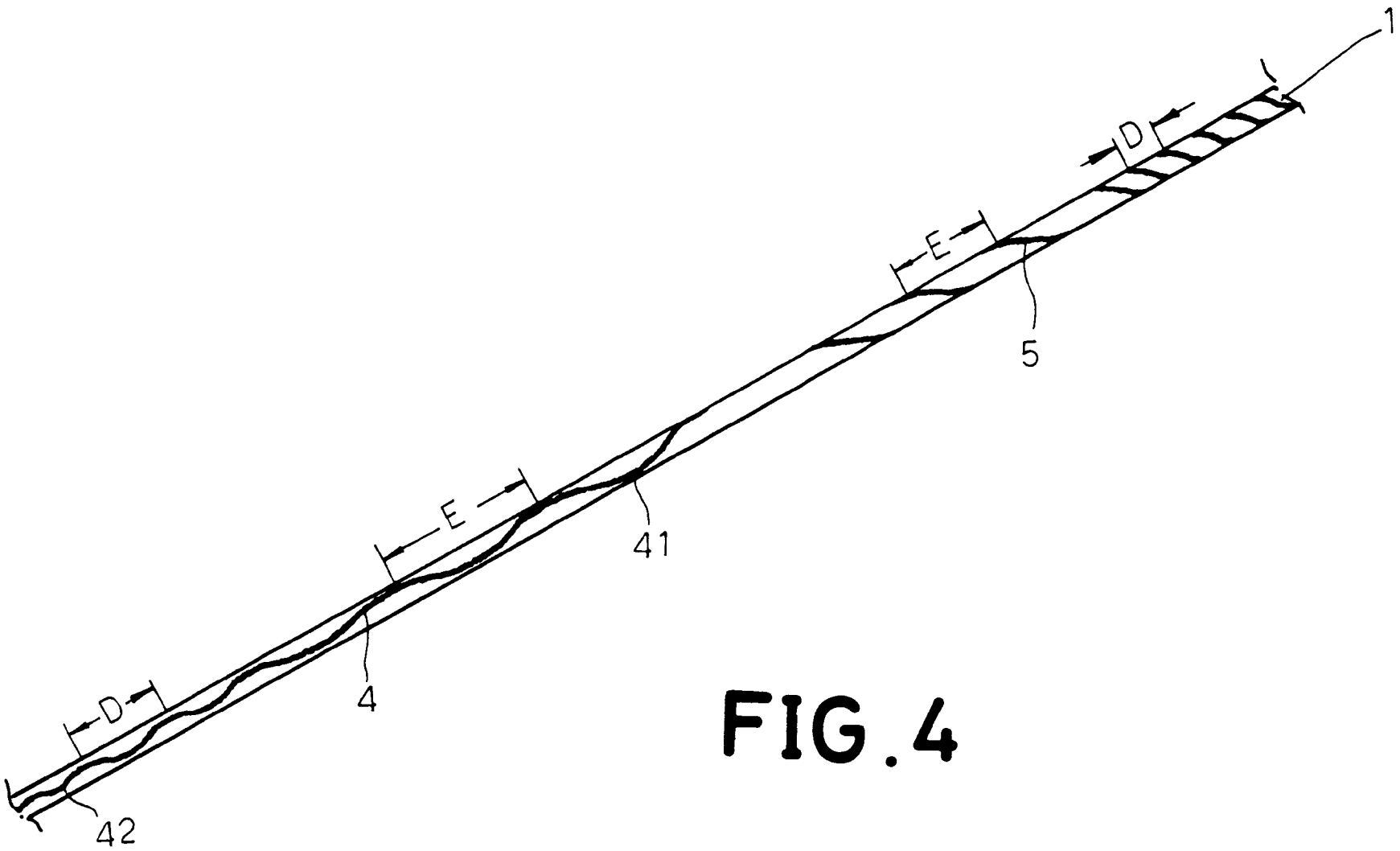
FIG. 4 illustrates compound patterns of braided stripe in the braided ribbon according to the present invention.

Referring to FIGS. from 1 through 4, a cord member 12 is inserted through the center through hole 22 of the disk-like thread guide, referenced by 2, of a braiding machine. (Braiding machines are well known in the art. Therefore, the braiding machine is not described in detail or illustrated herein.) Different colors of threads 11 are alternatively inserted through the equiangularly spaced peripheral thread holes 21 of the disk-like thread guide 2 around the cord member 12. The lead ends of the threads 11 and the cord member 12 are braided together and inserted through an output barrel 22, and then twisted by an external force F, forming a braided ribbon I having a particular pattern of braided stripe. If the direction of application of the external twisting force is alternatively changed, a wave-like pattern of braided stripe 4 is produced (see FIGS. 1, 2 and 4). If the direction of application of the external force F is a 360° rotary motion, a spiral pattern of braided stripe 5 is produced as shown in FIGS. 3 and 4. Employing the aforesaid two external force application methods produces a braided ribbon I having the wave-like pattern of braided stripe 4 and the spiral pattern of braided stripe 5 (see FIGS. 2, 3 and 4).

By means of controlling the speed of twisting in two alternative directions or the speed of rotary motion through 360°, the pitch of each pattern of braided stripe and its density are controlled. The pitch of the pattern is indirectly proportional to the speed of the external force employed. In FIG. 4, pitch D is the result of a high speed of external force, and pitch E is the result of a low speed of external force.

Referring to FIG. 4 again, when making the wave-like pattern of braided stripe 4, the length of time of the application of the external twisting force in each direction is directly proportional to the height of the wave-like pattern of braided stripe 4, i.e., the longer the external twisting force is the higher the wave-like pattern of braided stripe 4 will be.

The aforesaid external force F can be controlled manually. Manual control allows every operator to create different designs of braided ribbons. A programmable microprocessor-controlled controller means may be used to control the application of the aforesaid external force F, so as to fabricate predetermined designs of braided ribbons.

Referring to FIG. 1 again, the threads 11 can be of different thickness and/or different colors alternatively inserted through the equiangularly spaced peripheral thread holes 21 of the disk-like thread guide 2 around the cord member 12, and the core member 12 can be a braided fabric, elastic band, rubber filament, or any of a variety of flexible wires used to reinforce the strength of the braided ribbon 1. Further, the reference number 3 indicates the source of external force, which is for referenced only.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A braided ribbon fabrication method comprising the steps of:

a. installing a disk-like thread guide in a braiding machine, said disk-like thread guide having a center through hole and a plurality of thread holes equiangularly spaced around said center through hole;

b. inserting a cord member through the center through hole of said disk-like thread guide and alternatively inserting different thickness of threads through said thread holes of said disk-like thread guide;

c. braiding said cord member and said threads into a braided ribbon, enabling said braided ribbon to be extended out of an output barrel; and d. applying a rotary external force to the braided ribbon that extends out of said output barrel during braiding, so as to produce a pattern of braided stripe in a finished braided ribbon.

2. The braided ribbon fabrication method of claim 1 comprising the additional step of:

applying said rotary external force to twist said braided ribbon that extends out of said output barrel during braiding alternatively clockwise and counter-clockwise, so as to produce a wave-like pattern of braided stripe in said finished braided ribbon.

3. The braided ribbon fabrication method of claim 1 comprising the additional step of:

applying said rotary external force as a 360° rotary force to said braided ribbon that extends out of said output barrel alternatively clockwise and counter-clockwise during braiding, so as to produce a spiral pattern of braided stripe in said finished braided ribbon.

4. The braided ribbon fabrication method of claim 1 comprising the additional step of:

applying said rotary external force to twist said braided ribbon that extends out of said output barrel and applying a 360° rotary force to said braided ribbon that extends out of said output barrel alternatively clockwise and counter-clockwise during braiding, so as to produce a wave-like pattern of braided stripe and a spiral pattern of braided stripe in said finished braided ribbon.

5. The braided ribbon fabrication method of claim 1 wherein:

controlling a speed of application of said rotary external force applied to said braided ribbon that extends out of said output barrel during braiding so as to control a pitch of a pattern of braided stripe in said finished braided ribbon, said pitch of said pattern of braided stripe in said finished braided ribbon being indirectly proportional to said speed of application of said rotary external force.

6. The braided ribbon fabrication method of claim 1 wherein:

changing a direction of application of said rotary external force alternatively applied clockwise and counter-clockwise to said braided ribbon that extends out of said output barrel during braiding so as to control a height of a pattern of braided stripe in said finished braided ribbon, said height of said pattern of braided stripe in said finished braided ribbon being directly proportional to a length of time said rotary external force is applied in each direction.

7. The braided ribbon fabrication method of claim 1 wherein:

said rotary external force is applied manually.

8. The braided ribbon fabrication method of claim 1 wherein:

said rotary external force is applied mechanically.

9. A braided ribbon comprising a cord member, and a plurality of different thickness of threads braided on the periphery of said cord member to provide a wave-like pattern of braided stripe and a spiral pattern of braided stripe.

* * * * *